US005654067A

United States Patent [19]

Dinger et al.

[11] Patent Number: 5,654,067

[45] Date of Patent: Aug. 5, 1997

[54] FORMABLE, HEAT-STABILIZABLE TEXTILE LOOP PILE MATERIAL

[75] Inventors: Rolf Dinger, Grossaitingen; Joachim Wiegand, Bobingen; Armin Fendt, Graben, all of Germany

[73] Assignee: Hoechst Aktiengesellschaft, Germany

[21] Appl. No.: 604,919

[22] Filed: Feb. 22, 1996

[30] Foreign Application Priority Data

Feb. 22, 1995 [DE] Germany ..... 195 060 38.5

[51] Int. Cl.[6] ..... B32B 3/02; A46D 1/00; D04B 7/12; D03D 27/00

[52] U.S. Cl. ..... 428/95; 428/96; 428/97; 428/100; 139/391; 139/397; 139/407; 66/194; 24/448; 156/72

[58] Field of Search ..... 428/225, 229, 428/95, 96, 97, 100, 288, 296; 139/391, 397, 407; 66/194; 24/448; 156/72

[56] References Cited

U.S. PATENT DOCUMENTS

| | | | |
|---|---|---|---|
| 4,298,643 | 11/1981 | Miyagawa et al. | 428/85 |
| 4,532,099 | 7/1985 | Kaji | 428/229 |
| 5,470,648 | 11/1995 | Pearlman et al. | 428/229 |
| 5,536,551 | 7/1996 | Woosley | 428/95 |
| 5,540,980 | 7/1996 | Tolbert et al. | 428/229 |

FOREIGN PATENT DOCUMENTS

| | | |
|---|---|---|
| 4042063 | 7/1993 | Germany . |
| WO 94/20657 | 9/1994 | WIPO . |

OTHER PUBLICATIONS

Patent Abstracts of Japan, vol. 14, No. 74 (C–0687), Feb. 13, 1990 & JP–A–01 292139 (Kuraray Co Ltd), Nov. 24, 1989.

*Primary Examiner*—Terrel Morris
*Attorney, Agent, or Firm*—Connolly & Hutz

[57] ABSTRACT

Described is a loop pile material composed of a textile backing composed of a knit or woven and bound-in loop-forming pile yarns, wherein the textile backing consists of a multifilament hybrid yarn composed of at least 2 varieties A and B of filaments with or without cofilaments C, wherein said filaments A are textured, the melting point of said filaments B being at least 20° C., preferably at least 40° C., in particular at least 80° C., below the melting point of filaments A, the weight ratio of the filaments A:B being within the range from 20:80 to 80:20, preferably from 40:60 to 60:40, and the multifilament hybrid yarn additionally containing up to 40% by weight of cofilaments C, and the pile consists of loops with a length of 1 to 4 mm formed from a multifilament yarn having a yarn linear density of 30 to 200 dtex and filament linear densities of 5 to 25 dtex and/or from monofilaments having a linear density of 20 to 70 dtex.

The loop pile material is three-dimensionally deformable and heat-stabilizable and is used as the hook surface of hook-and-loop fastenings.

32 Claims, No Drawings

FORMABLE, HEAT-STABILIZABLE TEXTILE LOOP PILE MATERIAL

DESCRIPTION

The present invention relates to a loop pile material composed of a textile backing composed of a knit or woven and bound-in loop-forming pile yarns, the textile backing consisting of a multifilament hybrid yarn composed of a mixture of lower melting and crimped higher melting filaments, said loop pile material being capable of three-dimensional deformation and having a backing which can be consolidated by heat treatment. The pile material of the present invention is highly useful as the loop surface of hook-and-loop fastenings, in particular for large-area high-strength hook-and-loop fastenings.

Hook-and-loop fastenings are known, preferably in the form of bands, hook-and-loop fasteners, which can be used instead of zip fasteners. They consist of a band or fabric whose surface exhibits a multiplicity of small hooks, usually formed from polymer monofilaments, which forms the hook surface of the fastener and a complementary surface which exhibits a multiplicity of small loops, which forms the loop surface of the fastener, and in which, on uniting the two surfaces, the hooks become engaged and anchored. The loop surface thus forms the anchoring surface for the hooks of the hook surface.

Sheet materials composed of hybrid yarns composed of lower melting and higher melting fiber materials and consolidatable by heat treatment are likewise already known. For instance, EP-B-0359436 discloses louvre blinds where the louvre strips are of a fabric comprising lower melting and higher melting yarns, said fabric, once produced, being subjected to a heat treatment which causes the lower melting yarn components to melt and stiffen the fabric.

It is also known to use hybrid yarns having a high melting or unmeltable filament component and a thermoplastic lower melting filament component to produce sheet materials which, by heating to above the melting point of the thermoplastic, lower melting yarn component, can be converted into fiber-reinforced, stiff thermoplastic sheets, a kind or organic sheet-metal.

Various ways of producing fiber-reinforced thermoplastic sheet semifabricates are described in Chemiefasern/Textiltechnik, volume 39/91 (1989) pages T185 to T187, T224 to T228 and T236 to T240. The production starting from sheetlike textile materials composed of hybrid yarns is described there as an elegant way, which offers the advantage that the mixing ratio of reinforcing and matrix fibers can be very precisely controlled and that the drapability of textile materials makes it easy to place them in press molds (Chemiefasern/Textiltechnik volume 39/91 (1989), T186).

As revealed on page T238/T239 of this publication, however, problems arise when the textile materials are to be deformed in two dimensions. Since the extensibility of the reinforcing threads is generally negligible, textile sheets composed of conventional hybrid yarns can only be deformed because of their textile construction.

However, this deformability generally has narrow limits if creasing is to be avoided (T239), an experience that was confirmed by computer simulations.

The solution of pressing textiles composed of reinforcing and matrix threads in molds has the disadvantage that partial squashing occurs, which leads to a dislocation and/or crimping of the reinforcing threads and an attendant decrease in the reinforcing effect.

A further possibility discussed on page T239/T240 of producing three-dimensionally shaped articles having undislodged reinforcing threads would involve the production of three-dimensionally woven preforms, which, however, necessitates appreciable machine requirements, not only in the production of the preforms but also in the thermoplastic impregnation or coating;

Improved deformability of reinforcing layers is the object of the process known from DE-A-40 42 063. In this process, longitudinally deformable, namely heat-shrinking, auxiliary threads are incorporated into the sheet material intended for use as textile reinforcement. Heating releases the shrinkage and causes the textile material to contract somewhat, so that the reinforcing threads are held in a Wavy state or in a loose embrace.

Japanese Patent Offenlegungschrift 30 937/1984 discloses a pile material composed of a woven base into which the pile materials are bound. The woven base consists of a yarn composed of lower melting and higher melting fibers. Following the production of the woven and binding in of the pile, the material is heated to a temperature at which the lower melting fibers melt, consolidating the woven backing. The example given in this document reveals that the yarn used for producing the woven backing is a staple fiber yarn obtained by secondary spinning of a blend of lower and higher melting staple fibers.

However, these documents provide no information for the production of a pile material which is deformable, i.e. suitable for covering complicatedly shaped three-dimensional surfaces.

It is an object of the present invention to provide a loop pile material which, owing to its loop-forming pile, is suitable for use as the loop surface of hook-and-loop fastenings, is simple to produce, can be three-dimensionally deformed and hence also conformed without creasing to complicatedly shaped three-dimensionally styled surfaces, for example the inner surface of motor car doors, backrests of bucket seats, and whose backing can be consolidated and stiffened to an extent adapted to the requirements of further processing, by simply heating.

This object is achieved by the hereinafter described loop pile material of the present invention.

The present invention accordingly provides a loop pile material composed of a textile backing composed of a knit or woven and bound-in loop-forming pile yarns, wherein the textile backing consists of a multifilament hybrid yarn composed of at least 2 varieties A and B of filaments with or without cofilaments C, wherein said filaments A are textured and have a melting point above 180° C., and preferably above 220° C., in particular above 250° C., said filaments B have a melting point below 220° C., preferably below 200° C., in particular below 180° C., the melting point of said filaments B being at least 20° C., preferably at least 40° C., in particular at least 80° C., below the melting point of said filaments A, the weight ratio of said filaments A:B being within the range from 20:80 to 80:20, preferably from 40:60 to 60:40, and said multifilament hybrid yarn additionally containing up to 40% by weight of cofilaments C, and the pile consists of loops with a length of 1 to 4 mm formed from a multifilament yarn having a yarn linear density of 30 to 200 dtex and filament linear densities of 5 to 25 dtex and/or from monofilaments having a linear density of 20 to 70 dtex.

An essential advantage of this loop pile material is that it is capable of three-dimensional deformation. This useful property is particularly favored and achieved even when the backing is woven of the higher melting textured filaments A have a crimp of 3 to 50%, preferably of 8 to 30%, in particular of 10 to 20%. The crimping of the higher melting filaments can in principle be effected by all known methods in which a two- or three-dimensional crimp is set into the filaments at elevated temperature. Suitable known processes are for example stuffer box crimping, gear crimping, the knit-de-knit process, wherein a yarn is first knitted up into a hose, heat-set in that form and then unravelled again. The preferred process for texturing the filaments A, however, is the false-twist process described in numerous publications.

Advantageously, the higher melting textured filaments A are air jet textured or preferably false twist textured.

A further particularly useful property of the loop pile material of the present invention is that its backing can be consolidated by heat treatment. In the course of the heat treatment, the lower melting filaments B of the multifilament hybrid yarn of the textile backing form at least partially a matrix which interconnects the higher melting temperature texture filament yarns of the multifilament hybrid yarn to one another and to the pile yarn in the region of the plane of the backing. A matrix for the purposes of this invention is a continuous polyester mass formed by the complete or partial melting of the filaments B or by a mutual adhering of the filaments B softened to the point of tackiness.

To obtain this possibility of consolidation without allowing undesirable losses in respect of strength shape stability of the material under severe-duty conditions, or loop pile stability, it is convenient and advantageous for the filaments A to have a melting point of above 220° C., preferably of 220° to 300° C., in particular of 240°–280° C.

It is further convenient and advantageous for the filaments B to have a melting point of below 220° C., preferably of 110° to 220° C., in particular of 150° to 200° C.

It is thus essential for the present invention to use filament varieties A, B satisfying certain melting point targets.

The melting point of the filaments is determined on the polymer raw material used for making them. A special feature of many polymer materials, including, for example, polyester materials, is that they generally soften before melting and the melting process extends over a relatively large temperature range. It is nonetheless possible to determine readily reproducible temperature points which are characteristic of these polymer materials, for example polyester materials, at which the sample under investigation loses its geometric shape, i.e. passes into a liquid (albeit frequently highly viscous) state. The determination of these characteristic temperature points is effected using so-called penetrometers (analogously to DIN 51579 and 51580), where a measuring tip of defined dimension is placed under defined pressure onto a chip or pellet of the polymer sample to be investigated, the sample is then heated up at a defined heating-up rate, and the penetration of the measuring tip into the polymer material is monitored and measured.

As soon as the sample, for example the polyester sample, softens, the measuring tip begins to penetrate very slowly into the material.

The penetration of the measuring tip can slow down again at increasing temperature and even cease completely, if the softened, initially amorphous, polyester mass crystallizes.

In this case, a further increase in the temperature will reveal a second softening range which then turns into the below-described "melting range".

Said "melting range" is a certain fairly narrow temperature range characteristic of the material, in which a pronounced acceleration of the penetration of the measuring tip into the polyester material takes place. A temperature point can be defined as a readily reproducible melting point when the measuring tip has reached a certain penetration.

A melting point for the purposes of this invention is that temperature point (average of 5 measurements) at which a measuring tip with a circular contact area of 1 $mm^2$ and a contact weight of 0.5 g has penetrated 1000 μm into a polymer sample, for example a polyester sample, heated up at 5° C./min.

Not only for reasons specific to the production of the pile material of the present invention but also for reasons of a particularly advantageous distribution of the matrix material in the course of the consolidation of the backing (short flow paths), it is preferable for bundle coherence to exist between the filaments A and B and any C.

Bundle coherency between the filaments is necessary to form a thread structure which can be processed in the manner of a yarn, i.e. which can be woven or knitted, for example, without individual filaments of the assembly coming out of the assembly or forming major loops and thus leading to disruptions of the processing step.

The required bundle coherency can be brought about for example by imparting to the yarn a so-called protective twist of, for example, 10 to 100 turns/m or by spot-welding the filaments together. Preferably the required bundle coherency is brought about by interlacing in a Jet in which the filaments to be cohered together into a yarn are blasted from the side by a fast-moving gas jet while passing through a narrow yarn passageway. The degree of interlacing and hence the degree of bundle coherency can be varied by varying the force of the gas jet.

Preferably the filaments A, B and any C of the multifilament hybrid yarn are interlaced, the degree of interlacing of the multifilament hybrid yarn advantageously corresponding to an entanglement spacing of 10 to 100 mm.

The degree of interlacing is characterized in terms of the entanglement spacing measured with an Itemat hook-drop tester in accordance with the hook-drop test method described in U.S. Pat. No. 2,985,995.

Further preferred features of the multifilament hybrid yarn, which according to the application requirements or for convenience may be present individually or in varying combinations, are that the filaments B are flat, that the multifilament hybrid yarn contains no cofilaments C, that it has a linear density of 80 to 500 dtex, preferably 100 to 400 dtex, in particular 160 to 320 dtex, that the higher-melting textured filaments a have a filament linear density of 0.5 to 15 dtex, preferably of 2 to 10 dtex, and that the lower-melting filaments B have a filament linear density of 1 to 20 dtex, preferably of 3 to 15 dtex.

In the interests of good textile quality on the part of the pile material of the present invention, it is advantageous to use a multifilament hybrid yarn whose higher-melting textured filaments A have an initial modulus of 15 to 28 N/tex, preferably of 20 to 25 N/tex, and a tenacity of above 25 cN/tex, preferably of above 30 cN/tex, in particular of 30 to 40 cN/tex.

It has been found that, in the making of the backing, other yarns can be used as well as the multifilament hybrid yarn to be used according to the present invention, in which case these other yarns can be present mixed with the hybrid yarn or isolatedly in loop-free rows. Advantageously, however, the proportion of the multifilament hybrid yarn in the backing should be at least 20%, preferably at least 35%, in particular 40 to 100%.

For most applications it is advantageous for the basis weight of the loop pile material of the present invention to be 80 to 250 g/m$^2$, preferably 100 to 180 g/m$^2$, in particular 100 to 150 g/m$^2$ and for the weight ratio of the textile backing to pile yarn in the raw state material to be within the range from 90:10 to 50:50, preferably 85:15 to 70:30.

It is further advantageous for the loops to have a length of 1.0 to 4.0 mm, preferably of 1.0 to 3.0 mm.

In general, the loop pile material of the present invention will meet the requirements of a hook-and-loop fastening material when the pile yarn has a yarn linear density of 30 to 200 dtex, as mentioned above. Particular preference is given to the linear density range from 76 to 150 dtex.

At the same time the filament linear density of the pile yarn is normally 5 to 25 dtex, preferably 5 to 18 dtex, in particular 10 to 16 dtex.

The pile yarns can be flat. However, it appears that the interadhesion of the hook-and-loop fastening is further improved somewhat if the pile yarns are textured. It is therefore preferable for the pile yarns to be textured, preferably jet or false twist textured.

The loop pile of the loop pile material of the present invention, as well as or instead of the abovementioned relatively coarse, preferably textured, multifilament yarns, will also contain or consist of monofilaments. The monofilaments present in or forming the pile advantageously have linear densities of 20 to 70 dtex, preferably 33 to 50 dtex.

Since the pile has to bring about the adhesion of the material of the present invention to hook surfaces of pile fastenings, it will be readily understood that it consists of uncut pile yarn loops.

As mentioned above, one embodiment of the loop pile material of the present invention has a knitted fabric as textile backing.

In this embodiment, the backing of the loop pile material of the present invention can be knitted with synchronous or consecutive course formation.

The textile sheets measured with synchronous course formation can be warp-knitted or weft-knitted.

A knitted backing can have a rib, purl or plain construction and their known variants and also jacquard patterning.

As likewise already mentioned above, a further embodiment of the loop pile material of the present invention has a woven backing.

In principle, a woven backing may have any known weave construction such as plain weave and its derivatives.

The woven or knitted constructions are chosen according to the use intended for the textile material of the present invention, primarily from a technical aspect. The preferred knitted structure is rib, purl or plain, while the preferred woven structure is plain with or without simple derivations without major floats.

Preference is in each case given to the basic structures of the knits or wovens.

The density of the backing sheet will vary, depending on the use for which the material is intended and depending on the linear density of the yarns used, within the range from 10 to 25 threads/cm, preferably 14 to 20 threads/cm in warp and weft in the case of woven fabrics or around a corresponding stitch density of about 12 to 30 needles/inch, preferably 16 to 24 needles/inch in the case of knitted material. Within this range, the densities can of course be adapte to the intended application.

Depending on the requirements of the application, at least 20%, preferably 33 to 100%, of the stitches in a knitted backing would comprise pile yarns.

For the same reason it can be advantageous, in the case of a woven backing, for not every warp and/or weft thread to bind in pile tufts. In general, in a woven backing, 20% preferably 33 to 100%, of warp and/or weft threads bind in pile tufts.

The arrangement of the pile loops can be uniform over the entire area of the loop pile material, or the pile loops can be arranged in a density varying from place to place, for example repeatwise. For instance, regions of the loop pile material in which the stitches have loops can alternate with zones in which there are no loops.

To design sheets where the adhesion differs from place to place, the stitches of the base material can be combined with loops arranged in patterns, which is achieved through appropriate jacquardwise needle selection on the part of the knitting machine, or complete base courses without loops can be present.

For example, 1 to 5 loop courses can be followed by one or two courses without loops (cross rib effect). Even patterns having a weavelike character can be produced in this way. Designs produced in this way have longitudinal and/or transverse and/or diagonal alleys.

Unless there are special application requirements dictating the use of different materials in loop and base yarn, it is preferable to use polyester filament yarns for both.

Preferably, all the filaments of the pile yarn have a melting point which is at least 20° C., preferably at least 40° C., in particular at least 80° C., above the melting point of the filaments B of the multifilament hybrid yarn. If there are special reasons why this is not the case, care must be taken with the consolidation of the backing of the loop pile material of the present invention to ensure that the heat treatment is limited to the backing of the material, for example by contact heating on a heated surface, if a harshening of the pile yarn is to be avoided.

For particular applications where a stiffening of the pile loops is desired, however, the pile may also consist of the above-described multifilament hybrid yarn, if desired in the above-specified coarse titers, or the above-described pile yarn may comprise filaments B as present in the hybrid yarn. In these cases a heat treatment of the loop pile material will also result in a stiffening of the pile.

Suitable ranges in the above-specified linear density ranges are for example known under the trade names (R)TREVIRA TEXTURED and (R)TREVIRA MONOFIL, in various grades.

As mentioned above, the backing of the loop pile material of the present invention is constructed from a multifilament hybrid yarn comprising higher melting (A) and lower melting filaments (B), subject to the provisos that the melting points are a certain, technically dictated minimum distance apart and that said filaments A are textured. These features are necessary, but also sufficient, in order to impart to the loop pile material of the present invention, and its backing, the ability to deform and the capacity for thermoconsolidation.

The filaments A of the multifilament hybrid yarn are subject to the requirement that they melt above 180° C., preferably above 220° C., in particular above 250° C. In principle they consist of all spinnable materials meeting these requirements. Suitable are therefore not only natural polymer materials, for example filaments of regenerated cellulose or cellulose acetate, but also synthetic polymer filaments, which, because their mechanical and chemical properties are widely variable, are particularly preferred.

For instance, in principle, filaments A can consist of high performance polymers, such as, for example, polymers which, without or with only minimal drawing possibly after a heat treatment following the spinning operation, yield filaments having a very high initial modulus and a very high breaking strength (=tenacity). Such filaments are described in detail in Ullmann's Encyclopedia of Industrial Chemistry, 5th edition (1989), Volume A13, pages 1 to 21 and also Volume 21, pages 449 to 456. They consist for example of liquid-crystalline polyesters (LCP), polybenzimidazole (PBI), polyetherketone (PEK), polyetheretherketone (PEEK), polyetherimides (PEI), polyether sulfone (PESU), aramids such as poly(m-phenyleneisophthalamide) (PMIA), poly(m-phenyleneterephthalamide) (PMTA) or poly (phenylene sulfide) (PPS).

Generally, however, the use of such high-performance fibers is not necessary, nor advantageous having regard to the strength requirements of the backing material of the pile material of the present invention.

Advantageously, therefore, the filaments A consist of regenerated or modified cellulose, higher-melting polyamides (PA), for example 6-PA or 6,6-PA, polyvinyl alcohol, polyacrylonitrile, modacrylic polymers, polycarbonate, but in particular polyesters. Polyesters are suitable in particular for use as raw material for the filaments A because it is possible, in a relatively simple manner, through modification of the polyester chain, to vary the chemical, mechanical and other physical application-relevant properties, in particular, for example, the melting point.

Suitable polymer materials for the lower-melting filaments (B) likewise advantageously include spinnable polymers, for example vinyl polymers such as polyolefins, such as polyethylene or polypropylene, polybutene, lower-melting polyamides, for example 11-PA, or alicyclic polyamides (for example the product obtainable by condensation of 4,4'-diaminodicyclohexylmethane and decanecarboxylic acid), but in particular here too modified polyesters having a reduced melting point.

The pile yarns substantially determine the textile character of the pile material of the present invention. They can consist of all fiber and filament materials customarily used for producing the pile of pile materials, for example of plushes. For instance, the pile yarns can consist of staple fibers composed of natural fiber materials, for example cotton or wool, or composed of man-made natural polymer fiber materials, or else of synthetic fibers and filaments. Similarly, blends of natural and synthetic fibers can be present in the pile yarn if this meets the requirements of the end-user. The pile yarns are generally dyed, for example spun-dyed, and frequent use is made of yarns having different colorings in order to achieve certain decorative effects.

Preferably, for the abovementioned reason, the pile yarns are textured.

As explained earlier, it is particularly advantageous for the higher-melting textured filaments A to be polyester filaments and that it is then particularly advantageous for also the lower-melting filaments B to consist of modified polyester having a reduced melting point.

In a preferred embodiment of the present invention, the pile yarn consists of the same polymer class as the backing yarns. It is particularly preferable for the pile yarn to be a polyester yarn.

If the backing yarn and the pile yarn consist essentially of the same polymer class, appreciable advantages result with respect to the disposal of the used material. This is because such a single-material product is particularly simple to recycle, for example by simple melting and regranulation.

If the polymer material of backing and pile is polyester, it is additionally possible to recover useful raw materials from the used products, for example by alcoholysis, for producing virgin polyesters. Polyesters for the purposes of this invention also include copolyesters constructed from more than one variety of dicarboxic acid radical and/or more than one variety of diol radical.

A polyester from which the fiber materials of the pile material of the present invention are made contains at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form the predominant proportion of the dicarboxylic acid units or are derived from araliphatic dicarboxylic acids having one or more, preferably one or two, fused or unfused aromatic nuclei, or from aliphatic dicarboxylic acids having in total 4 to 12 carbon atoms, preferably 6 to 10 carbon atoms, and diol units derived from branched and/or longer-chain diols having 3 to 10, preferably 3 to 6, carbon atoms or from cyclic diols, or from diols which contain ether groups or, if present in a minor amount, from polyglycol having a molecular weight of about 500–2000.

Specifically, the polyester of the core, based on the totality of all polyester structural units, is composed of 35 to 50 mol % of units of the formula —CO—$A^1$—CO— (I)

0 to 15 mol % of units of the formula —CO—$A^2$—CO— (II)

35 to 50 mol % of units of the formula —O—$D^1$—O— (III)

0 to 15 mol % of units of the formula —O—$D^2$—O— (IV)

and 0 to 25 mol % of units of the formula —O—$A^3$—CO— (V)

where $A^1$ denotes aromatic radicals having 5 to 12, preferably 6 to 10, carbon atoms, $A^2$ denotes aromatic radicals other than $A^1$ or araliphatic radicals having 5 to 16, preferably 6 to 12, carbon atoms or aliphatic radicals having 2 to 10 carbon atoms, preferably 4 to 8 carbon atoms, $A^3$ denotes aromatic radicals having 5 to 12, preferably 6 to 10, carbon atoms, $D^1$ denotes alkylene or polymethylene groups having 2 to 4 carbon atoms or cycloalkane or dimethylenecycloalkane groups having 6 to 10 carbon atoms, $D^2$ denotes non-$D^1$ alkylene or polymethylene groups having 3 to 4 carbon atoms or cycloalkane or dimethylenecycloalkane groups having 6 to 10 carbon atoms or straight-chain or branched alkanediyl groups having 4 to 16, preferably 4 to 8, carbon atoms, or radicals of the formula —$(C_2H_4—O)_m—C_2H_4$—, where m is an integer from 1 to 40, m=1 or 2 being preferred for proportions up to 20 mol % and groups having m=10 to 40 being preferably present only in proportions of below 5 mol %, the proportions of the basic units I and III and of the modifying units II, IV and V being selected within the framework of the above-specified ranges so that the polyester has the desired melting point.

The novel pile materials whose fiber materials consist of such polyesters, in particular polyethylene terephthelate, are not readily flammable.

The low flammability may be additionally enhanced by using flame retardant polyesters. Flame retardant polyesters are known. They include additions of halogen compounds, in particular bromine compounds, or, particularly advantageously, they include phosphorus compounds cocondensed in the polyester chain. Particularly preferred flame retardant pile materials of the present invention include in the backing and/or pile yarns composed of polyesters including, cocondensed in the chain, units of the formula

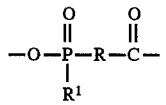

VI where R is alkylene or polymethylene having 2 to 6 carbon atoms or phenyl and $R^1$ is alkyl having 1 to 6 carbon atoms, aryl or aralkyl.

Preferably, in the formula VI, R is ethylene and R1 is methyl, ethyl, phenyl or o—, m— or p-methylphenyl, in particular methyl.

The units of the formula VI are advantageously present in the polyester chain up to 15 mol %, preferably in a proportion of 1 to 10 mol %.

It is of particular advantage for the polyesters used not to contain more than 60 meq/kg, preferably less than 30 meq/kg, of capped carboxyl end groups and less than 5 meq/kg, preferably less than 2 meq/kg, in particular less than 1.5 meq/kg, of free carboxyl end groups. Preferably, therefore, the polyester has for example mono- or bis- and/or polycarbodiimide-capped carboxyl end groups. In a further embodiment, having regard to prolonged hydrolysis stability, the polyester of the core and the polyester of the polyester mixture of the sheath comprises not more than 200 ppm, preferably not more than 50 ppm, in particular from 0 to 20 ppm, of mono- and/or biscarbodiimides and from 0.02 to 0.6% by weight, preferably from 0.05 to 0.5% by weight, of free polycarbodiimide having an average molecular weight of 2000 to 15,000, preferably of 5000 to 10,000.

The polyesters of the yarns present in the pile material of the present invention may in addition to the polymer materials include up to 10% by weight of nonpolymeric substances, such as modifying additives, fillers, delusterants, color pigments, dyes, stabilizers, such as UV absorbers, antioxidants, hydrolysis, light and temperature stabilizers and/or processing aids.

The present invention also provides the consolidated above-described pile materials, i.e. those in which the lower-melting filaments B of the multifilament hybrid yarn of the textile backing form at least partially a matrix which interconnects the higher-melting textured filaments of the multifilament hybrid yarn to one another and to the pile yarn in the region of the plane of the backing.

It is a special characteristic of this material that not only the backing is consolidated by at least partial matrix formation of said filaments B of said multifilament hybrid yarn of said backing, but also, surprisingly, the anchorage of the pile yarn in the backing is higher than the tensile strength of the pile yarn.

The present invention further provides a process for producing a loop pile material, to be thermally consolidated, composed of a textile backing composed of a knit or woven and bound-in loop-forming pile yarns by weaving or knitting a fabric with bound-in loop, which comprises feeding the weaving or knitting machine with a yarn to form the textile backing sheets of the loop pile material which is at least 30%, preferably at least 75%, a multifilament hybrid yarn composed of at least 2 varieties A and B of filaments with or without cofilaments C, wherein said filaments A are textured and have a melting point above 180° C., and preferably above 220° C., in particular above 250° C., said filaments B have a melting point below 220° C., preferably below 200° C., in particular below 180° C., the melting point of said filaments B being at least 20° C., preferably at least 40° C., in particular at least 80° C., below the melting point of said filaments A, the weight ratio of said filaments A:B being within the range from 20:80 to 80:20, preferably from 40:60 to 60:40, and said multifilament hybrid yarn additionally containing up to 40% by weight of cofilaments C, and to form the pile feeding the weaving or knitting with a multifilament yarn having a yarn linear density of 30 to 200 dtex and filament linear densities of 5 to 25 dtex and/or monofilaments having a linear density of 20 to 70 dtex.

Subsequently the pile woven or knit obtained may be subjected to a consolidating heat treatment, which may be an optionally integral part of the process of the present invention, at a temperature at which said lower melting filaments B of said multifilament hybrid yarn soften. The consolidated loop pile material thus produced is likewise part of the subject-matter of the present invention.

The temperature of the final heat treatment and the treatment duration depend on the desired degree of consolidation and the melting point of the filaments B of the multifilament hybrid yarn.

In general, the heat treatment is carried out at 100 to 200° C., preferably at 120° to 180° C.

In practice, it will be found very advantageous to preset the raw state material of the pile woven or knit produced by a heat treatment at a relatively low temperature, for example by steaming, on a tenter. This eliminates the curling tendency of the raw state material it becomes more compliant for the further processing steps, and the pile becomes better anchored (loop stabilization) and thus is better able to resist mechanical tensile stresses. A particular advantage associated with pre-setting is that no lamination is necessary to force the planar position and little, if any, edge-cutting waste is produced.

It is therefore preferable for the raw state material of the pile woven or knit to be pre-set on a tenter.

Preferably the filaments B in the multifilament hybrid yarn used for forming the backing are flat.

Furthermore, the process is controlled in accordance with the performance requirements in such a way that the basis weight of the loop pile material is 80 to 250 g/m$^2$, preferably 100 to 180 g/m$^2$, in particular 100 to 150 g/m$^2$, and the feed ratio of backing yarn to pile yarn is within the range from 90:10 to 60:50, preferably within the range from 85:15 to 70:30.

The process is controlled in such a way according to the desired pile density and patterning that a knitted backing will have pile yarns in at least 10%, preferably 33 to 100%, of the stitches, while a woven backing will have pile tufts bound in by 10%, preferably 33 to 100%, of the warp and/or weft threads.

In the preferred embodiment, the loop pile material of the present invention is a single-product material and therefore has the above-described advantages in respect of disposal/recycling. In addition, the present invention affords further advantages, namely the saving of the application of a skin prior to further processing, the possibility of stiffening the backing and at the same time densifying it so as to make possible direct composite molding, for example with foams, without the foam striking through to the pile side. It is particularly advantageous that the pile material, even with a woven backing, possesses very good three-dimensional deformability, resulting from the use of the herein described multifilament hybrid yarn in the making of the backing. Owing to the very stable loops of which the pile is made in combination with the good deformability and the optimizable flexibility of the backing, which ensures uniform contact even on complicatedly shaped hook surfaces of hook-and-loop fastenings, the result is an unusually good adhesion between the surfaces. The very strong binding-in of the loop pile in the backing achieved according to the present invention, which, as explained above, equals or even exceeds the breaking strength of the pile yarn, is responsible for the fact that the loop surface of the present invention provides very high interadhesion of the hook-loop-fastening and excellent snag resistance despite its relatively low basis weight.

The examples which follow illustrate the production of the multifilament hybrid yarn of the present invention and its use in the production of a loop pile material of the present invention.

EXAMPLE 1

Production of the base yarn used for the backing:

A hybrid yarn is produced by folding a black (spun-dyed), textured 167 dtex 32 filament yarn composed of unmodified polyethylene terephthalate (raw material melting point 265° C.) (®TREVIRA Type 536) with a 140 dtex 24 filament yarn composed of polyethylene terephthalate modified with isophthalic acid (raw material melting point 110° to 120° C.) and intermingling in an interlacing jet operated using an air pressure of 2 bar, leaving the lower melting yarn essentially flat.

EXAMPLE 2

An MLPX plushing machine with 20 needles/inch and a cylinder diameter of 26" is used to produce a knitted fabric.

Using 40% of base yarn as described in Example 1 and 39% of a textured 167 dtex 32 filament polyester yarn (®TREVIRA textured Type 556) for the formation of the base and 21% of an ecru textured 84 dtex 6 filament polyester yarn ®TREVIRA textured) to form the loops, the product obtained is a loop pile material in accordance with the present invention.

Construction: 1:1 short loop plush 2.5 mm (hybrid yarn plaited with loop yarn), with full inter-course (base only, no loops).

Raw state setting: 126 g/m$^2$.

Subsequently the material is washed (open-width wash 40° C.), and at 160° C. tenter dried, set and finished. The finished material has a basis weight of 126 g/m$^2$.

Owing to the use of the multifilament hybrid yarn, the otherwise customary edge gluing is not necessary, since the material lies perfectly flat. It is highly suitable for use as the loop surface of large-area high-strength hook-and-loop fastenings.

What is claimed is:

1. A loop pile material composed of a knit or woven textile backing and bound-in loop-forming pile yarns, wherein the textile backing consists of a multifilament hybrid yarn composed of at least 2 varieties A and B of filaments with or without cofilaments C, wherein said filaments A are textured and have a melting point above 180° C., said filaments B having a melting point below 220° C., the melting point of said filaments B being at least 20° C. below the melting point of said filaments A, a weight ratio of said filaments A:B being within the range from 20:80 to 80:20 and said multifilament hybrid yarn additionally containing up to 40% by weight of cofilaments C, and the pile consists of loops with a length of 1 to 4 mm and said pile comprises monofilaments having a linear density of 20 to 70 dtex.

2. The loop pile material of claim 1, wherein said filaments A are textured and have a melting point above 220° C., said filaments B have a melting point below 200° C., the melting point of said filaments B being at least 40° C. below the melting point of said filaments A.

3. The loop pile material of claim 1, wherein said filaments A are textured and have a melting point above 250° C., said filaments B have a melting point below 180° C., the melting point of said filaments B being at least 80° C. below the melting point of said filaments A.

4. The loop pile material of claim 1, wherein the weight ratio of said filaments A:B is within the range from 40:60 to 60:40.

5. The loop pile material of claim 1, wherein said higher melting textured filaments A of said multifilament hybrid yarn are crimped.

6. The loop pile material of claim 1, wherein the textile backing is consolidated by a heat treatment.

7. The loop pile material of claim 1, wherein said filaments A of said multifilament hybrid yarn have a melting point of 220° to 300° C.

8. The loop pile material of claim 1, wherein said filaments A of said multifilament hybrid yarn have a melting point of 240°–280° C.

9. The loop pile material of claim 1, wherein said filaments B of said multifilament hybrid yarn have a melting point of 110° to 220° C.

10. The loop pile material of claim 1, wherein said filaments B of said multifilament hybrid yarn have a melting point of 150° to 200° C.

11. The loop pile material of claim 1, wherein said filaments A and B of said multifilament hybrid yarn and any C are closely bundled together forming a thread.

12. The loop pile material of claim 1, wherein said multifilament hybrid yarn has a linear density of 80 to 500 dtex and said higher melting textured filaments A of said multi-filament hybrid yarn have a linear density of 0.5 to 15 dtex and said lower-melting filaments B of said multifilament hybrid yarn have a linear density of 1 to 20 dtex.

13. The loop pile material of claim 1, wherein said multifilament hybrid yarn has a linear density of 100 to 400 dtex and said higher melting textured filaments A of said multi-filament hybrid yarn have a linear density of 2 to 10 dtex and said lower melting filaments B of said multifilament hybrid yarn have a linear density of 3 to 15 dtex.

14. The loop pile material of claim 1, wherein said multifilament hybrid yarn has a linear density of 160 to 320 dtex and said higher melting textured filaments A of said multi-filament hybrid yarn have a linear density of 2 to 10 dtex and said lower-melting filaments B of said multifilament hybrid yarn have a linear density of 3 to 15 dtex.

15. The loop pile material of claim 1, having a basis weight of 80 to 250 g/m$^2$.

16. The loop pile material of claim 1, having a basis weight of 100 to 180 g/m$^2$.

17. The loop pile material of claim 1, wherein a weight ratio of textile backing to pile yarn in the raw state material is within a range from 90:10 to 50:50.

18. The loop pile material of claim 1, wherein the pile yarn has a yarn linear density of 30 to 200 dtex.

19. The loop pile material of claim 1, wherein the pile yarn has a yarn linear density of 76 to 150 dtex.

20. The loop pile material of claim 1, wherein the pile yarn has a filament linear density of 5 to 18 dtex.

21. The loop pile material of claim 1, wherein the pile monofilaments have a linear density of 33 to 50 dtex.

22. The loop pile material of claim 1, wherein backing yarns and pile yarn consist of the same polymer class.

23. The loop pile material of claim 1, wherein backing yarns and pile yarn consist of polyesters.

24. The loop pile material of claim 23, wherein the polyesters contain at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form a predominant portion of the dicarboxylic acid units or are derived from araliphatic dicarboxylic acids having one or more, fused or unfused aromatic nuclei, or from cyclic or acyclic aliphatic dicarboxylic acids having in total 4 to 12 carbon atoms and diol units derived from branched and/or longer-chain diols having 3 to 10 carbon atoms or from cyclic diols, or from diols which contain ether groups.

25. The loop pile material of claim 23, wherein the polyesters contain, as cocondensed units, groups of the formula VI

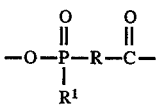

where R is alkylene or polymethylene having 2 to 6 carbon atoms or phenyl, and $R^1$ is alkyl having 1 to 6 carbon atoms, aryl or aralkyl.

26. The loop pile material of claim 1, wherein all the filaments of the pile yarn have a melting point which is at least 20° C. above the melting point of said filaments B of said multifilament hybrid yarn.

27. The loop pile material of claim 1, wherein all the filaments of the pile yarn have a melting point which is at least 40° C. above the melting point of said filaments B of said multifilament hybrid yarn.

28. The loop pile material of claim 1, wherein all the filaments of the pile yarn have a melting point which is at least 80° C., above the melting point of said filaments B of said multifilament hybrid yarn.

29. The loop pile material of claim 1, wherein said backing is consolidated by at least partial matrix formation of said filaments B of said multifilament hybrid yarn of said backing.

30. A process for producing a loop pile material, to be thermally consolidated, composed of a knit or woven textile backing and bound-in loop-forming pile yarns by weaving or knitting a fabric with bound-in loop, which comprises feeding a weaving or knitting machine with a yarn to form the textile backing of the loop pile material which is at least 30% a multifilament hybrid yarn composed of at least 2 varieties A and B of filaments with or without cofilaments C, wherein said filaments A are textured and have a melting point above 180° C.

said filaments B have a melting point below 220° C., the melting point of said filaments B being at least 20° C. below the melting point of said filaments A, a weight ratio of said filaments A:B being within the range from 20:80 to 80:20 and said multifilament hybrid yarn additionally containing up to 40% by weight of cofilaments C, and forming the pile by feeding the weaving or knitting machine with monofilaments having a linear density of 20 to 70 dtex.

31. The process of claim 30, wherein the loop pile material is subjected to a consolidating heat treatment at a temperature at which said lower melting filaments B of said multifilament hybrid yarn soften.

32. The process of claim 30, wherein said heat treatment is carried out at 100° to 200° C.

* * * * *

UNITED STATES PATENT AND TRADEMARK OFFICE

CERTIFICATE OF CORRECTION

PATENT NO. : 5,654,067

DATED : August 5, 1997

INVENTOR(S) : Rolf Dinger et al

It is certified that error appears in the above-identified patent and that said Letters Patent is hereby corrected as shown below:

Column 4, line 49, "filaments a" should read -- filaments A --.

Column 5, line 61, "adapte" should read -- adapted --.

Signed and Sealed this

Tenth Day of February, 1998

*Attest:*

Bruce Lehman

BRUCE LEHMAN

*Attesting Officer*

*Commissioner of Patents and Trademarks*